US010172429B1

(12) United States Patent
Smith et al.

(10) Patent No.: US 10,172,429 B1
(45) Date of Patent: Jan. 8, 2019

(54) BACKPACK WITH RETRACTABLE HANDLE AND WHEELS

(71) Applicants: Shalonda Smith, Kileen, TX (US); Avary Kemp, Jr., Kileen, TX (US)

(72) Inventors: Shalonda Smith, Kileen, TX (US); Avary Kemp, Jr., Kileen, TX (US)

( * ) Notice: Subject to any disclaimer, the term of this patent is extended or adjusted under 35 U.S.C. 154(b) by 184 days.

(21) Appl. No.: 15/333,533

(22) Filed: Oct. 25, 2016

(51) Int. Cl.

| | |
|---|---|
| ***A45C 5/14*** | (2006.01) |
| ***A45C 13/26*** | (2006.01) |
| ***A45F 3/04*** | (2006.01) |
| ***A45C 5/03*** | (2006.01) |
| ***A45C 5/06*** | (2006.01) |
| ***A45C 5/08*** | (2006.01) |
| ***A45C 13/10*** | (2006.01) |

(52) U.S. Cl.
CPC ..... *A45C 13/262* (2013.01); *A45C 5/03* (2013.01); *A45C 5/06* (2013.01); *A45C 5/08* (2013.01); *A45C 5/146* (2013.01); *A45C 13/10* (2013.01); *A45C 13/103* (2013.01); *A45C 13/1076* (2013.01); *A45F 3/04* (2013.01); *A45C 2013/1015* (2013.01)

(58) Field of Classification Search
CPC . A45C 5/146; A45C 2013/267; A45C 13/262; A45C 5/03; A45C 5/06; A45C 5/08; A45C 13/10; A45C 13/103; A45C 13/1076; A45C 2013/1015; A45F 3/04
See application file for complete search history.

(56) References Cited

U.S. PATENT DOCUMENTS

| | | | | |
|---|---|---|---|---|
| 3,141,680 | A * | 7/1964 | McCord | A45C 5/146 280/38 |
| 5,984,154 | A | 11/1999 | Scicluna | |
| 6,179,176 | B1 | 1/2001 | Saggese | |
| 6,742,684 | B2 | 6/2004 | Oh | |
| 7,237,660 | B2 * | 7/2007 | Wu | A45C 5/146 190/115 |
| 7,322,452 | B2 | 1/2008 | Nykoluk | |
| 7,503,439 | B2 | 3/2009 | O'Shea | |
| 8,757,642 | B2 * | 6/2014 | Arthur | A45C 5/146 16/34 |
| 9,468,277 | B2 * | 10/2016 | King | A45C 5/146 |
| 2004/0195791 | A1 * | 10/2004 | Brookes-Inglis | A45C 5/14 280/47.26 |
| 2009/0159622 | A1 | 6/2009 | Smith | |

FOREIGN PATENT DOCUMENTS

| | | | |
|---|---|---|---|
| FR | 1145985 | A1 * | 11/1955 |
| WO | 2005035400 | A2 | 4/2005 |

* cited by examiner

*Primary Examiner* — Tri Mai

(57) ABSTRACT

The backpack with retractable handle and wheels comprises an extendable handle, a plurality of wheel mechanisms and a luggage item. The luggage item is modified to further comprise a center channel, a grip aperture, a plurality of wheel cavities, and a plurality of wheel covers. The extendable handle is stored within the center channel. The extendable handle projects through the grip aperture such that the extendable handle may be withdrawn from the center channel. The backpack with retractable handle and wheels is designed such that each of the plurality of wheel mechanisms is stored in a wheel cavity selected from the plurality of wheel cavities. Each of the plurality of wheel mechanisms is mechanically linked to the extendable handle such that when the extendable handle is withdrawn from the center channel each of the plurality of wheels extends out of its corresponding wheel channel.

11 Claims, 6 Drawing Sheets

BACKPACK WITH RETRACTABLE HANDLE AND WHEELS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including hand or traveling articles, more specifically, rigid or semi-rigid luggage with retractable rolling means.

SUMMARY OF INVENTION

The backpack with retractable handle and wheels comprises an extendable handle, a plurality of wheel mechanisms and a luggage item. The luggage item is a commercially available luggage item that is modified to further comprise a center channel, a grip aperture, a plurality of wheel cavities, and a plurality of wheel covers. The extendable handle is a handle that is stored within the center channel. The extendable handle projects through the grip aperture such that the extendable handle may be withdrawn from the center channel such that the extendable projects into the exterior space of the luggage item. The backpack with retractable handle and wheels is designed such that each of the plurality of wheel mechanisms is stored in a wheel cavity selected from the plurality of wheel cavities. Each of the plurality of wheel mechanisms is mechanically linked to the extendable handle such that when the extendable handle is withdrawn from the center channel each of the plurality of wheels extends out of its corresponding wheel channel into the exterior space of the luggage item.

These together with additional objects, features and advantages of the backpack with retractable handle and wheels will be readily apparent to those of ordinary skill in the art upon reading the following detailed description of the presently preferred, but nonetheless illustrative, embodiments when taken in conjunction with the accompanying drawings.

In this respect, before explaining the current embodiments of the backpack with retractable handle and wheels in detail, it is to be understood that the backpack with retractable handle and wheels is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the backpack with retractable handle and wheels.

It is therefore important that the claims be regarded as including such equivalent construction insofar as they do not depart from the spirit and scope of the backpack with retractable handle and wheels. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
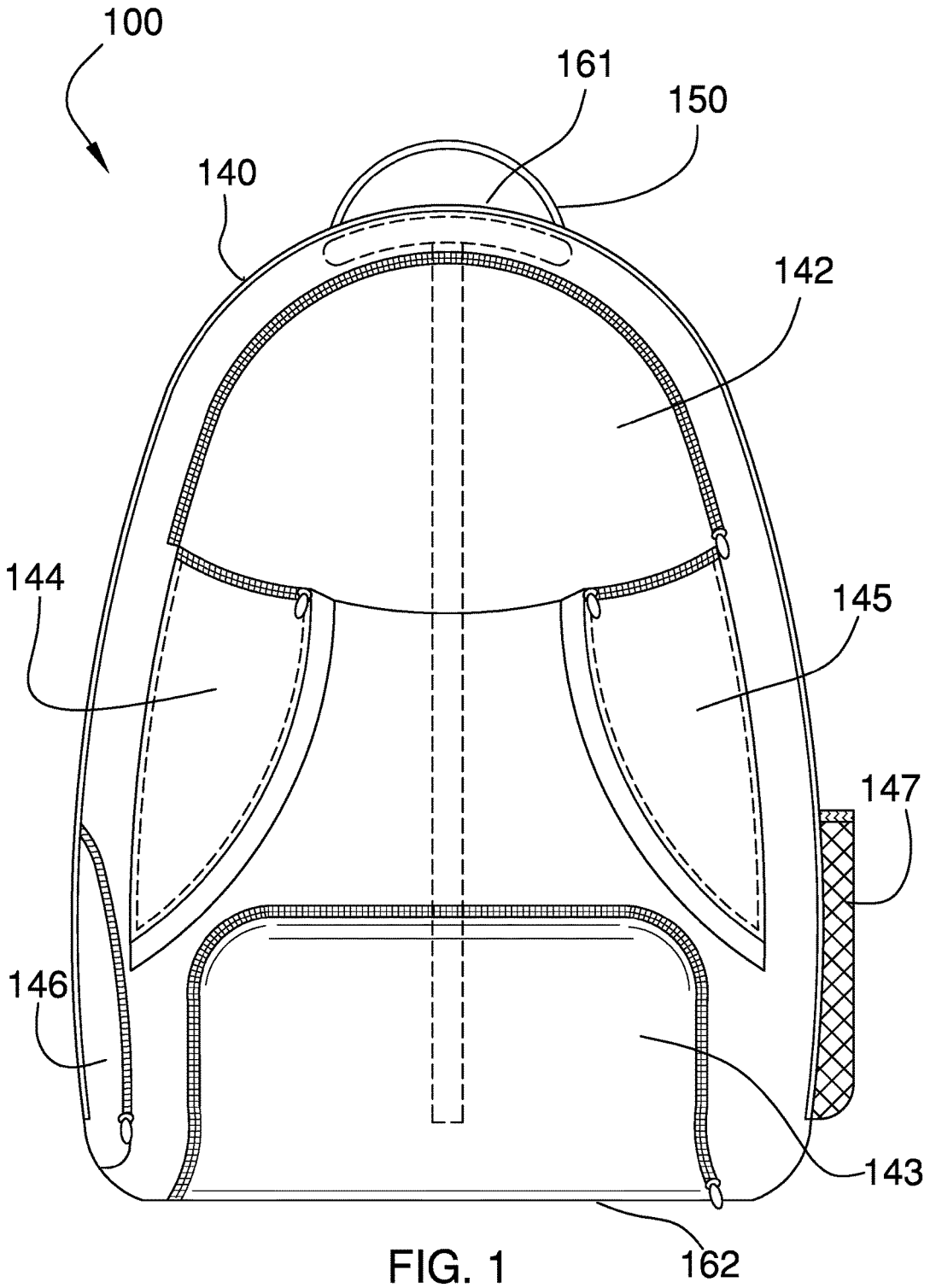
FIG. 1 is a front view of an embodiment of the disclosure.
Figure 2:
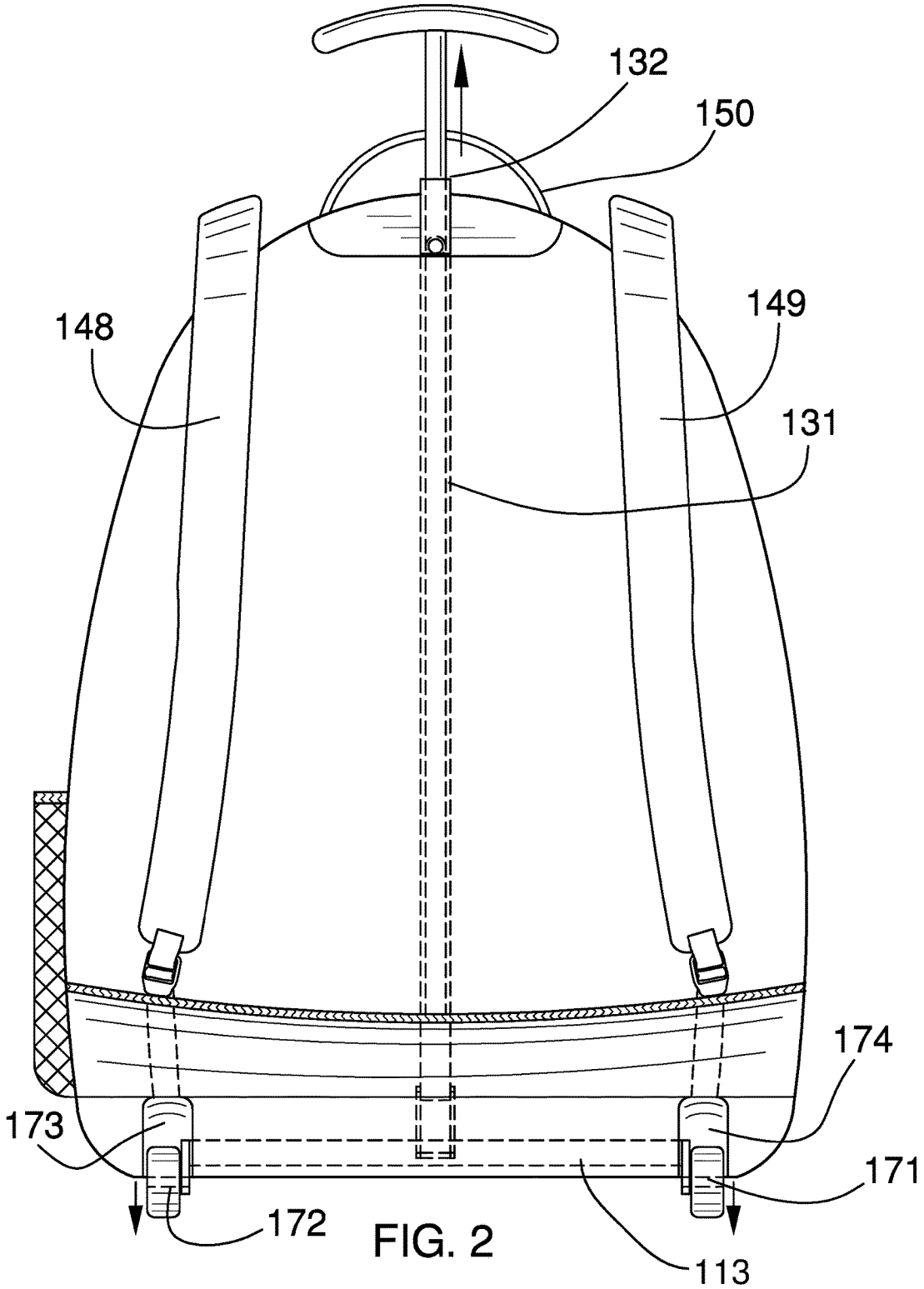
FIG. 2 is a rear view of an embodiment of the disclosure.
Figure 3:
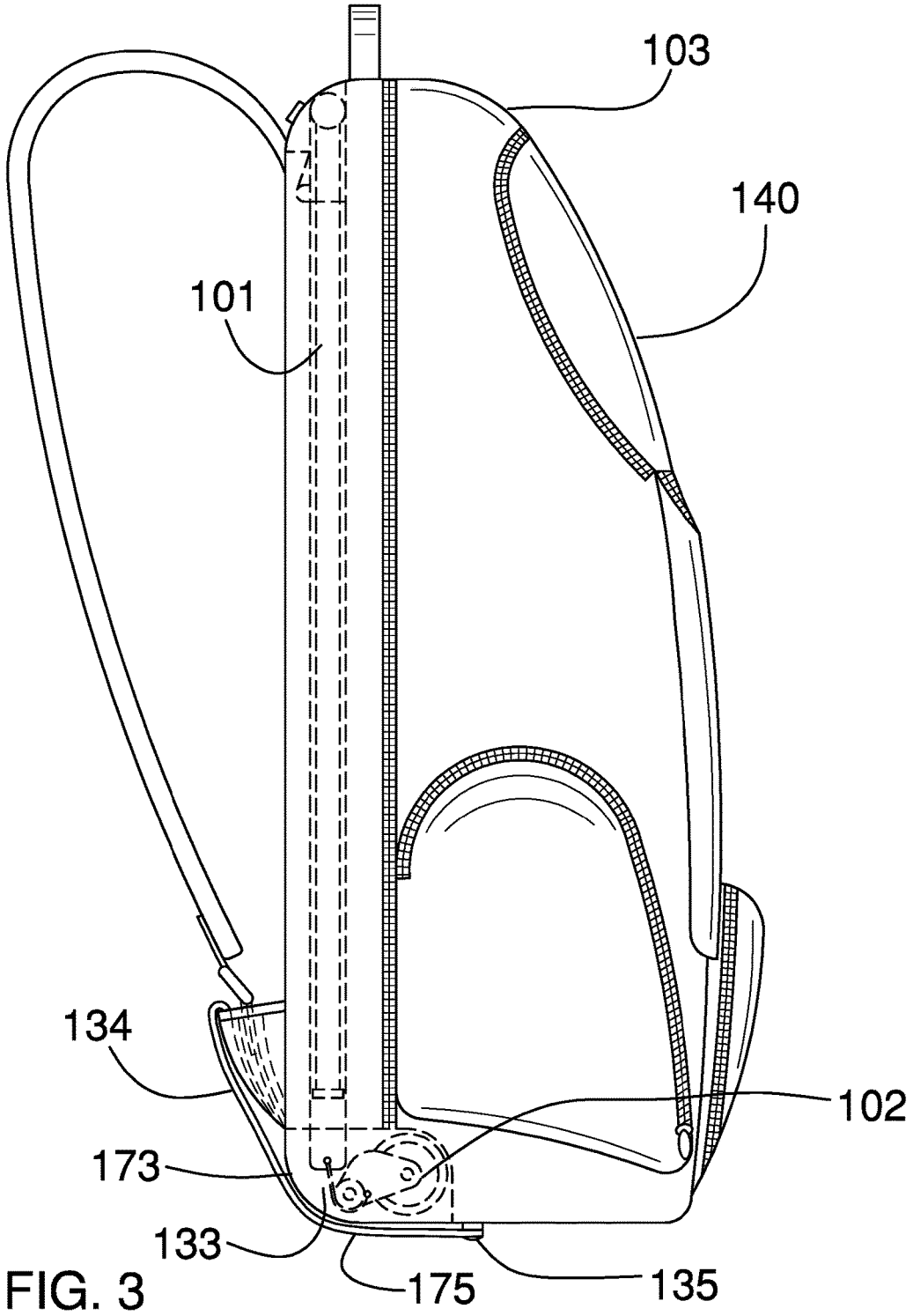
FIG. 3 is a left side view of an embodiment of the disclosure.
Figure 4:
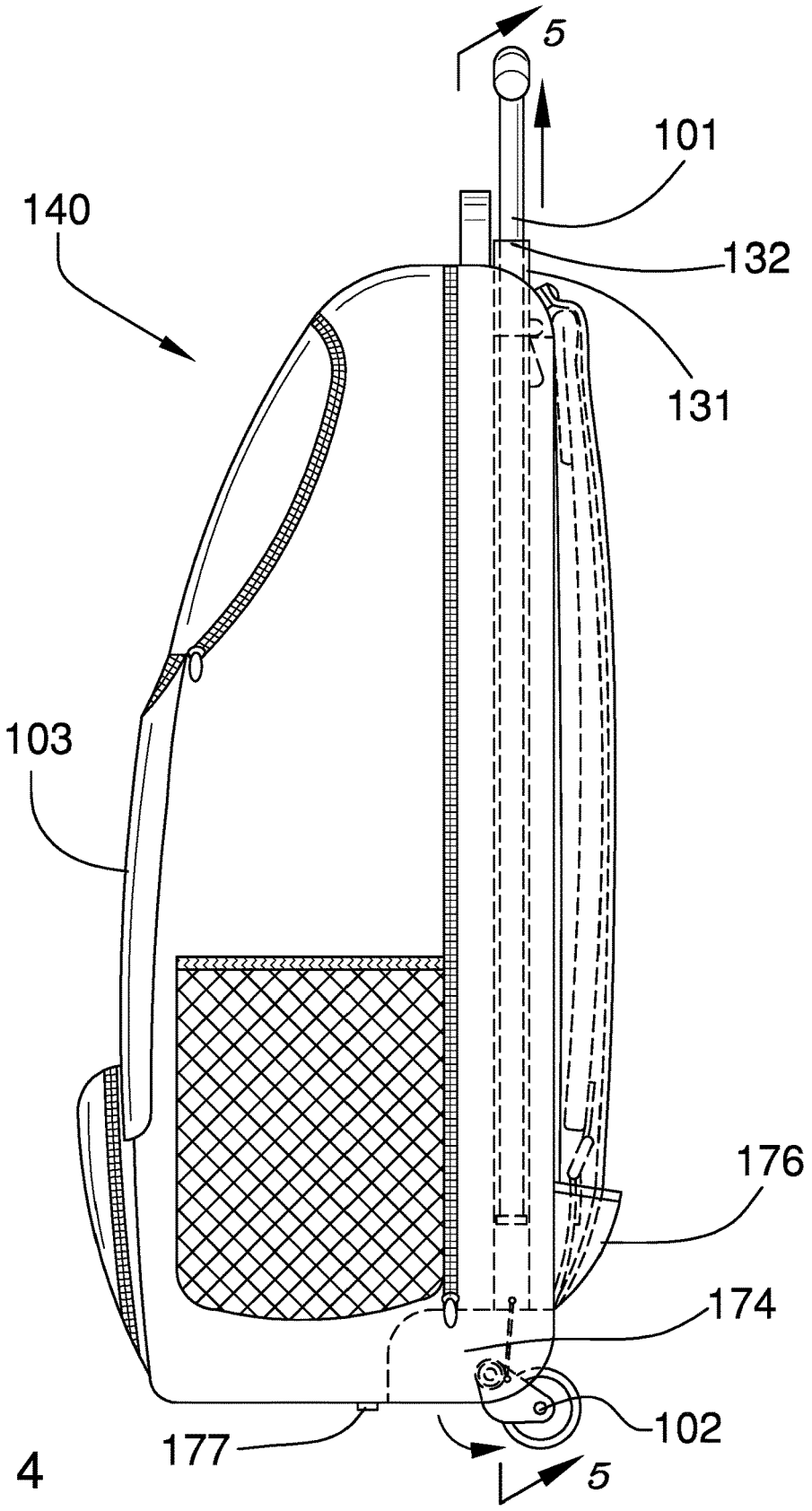
FIG. 4 is a right side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The invention 100 comprises an extendable handle 101, a plurality of wheel mechanisms 102 and a luggage item 103. The luggage item 103 is a commercially available luggage item 103 that is modified to further comprise a center channel 131, a grip aperture 132, a plurality of wheel cavities 133, and a plurality of wheel covers 134. The extendable handle 101 is a handle that is stored within the center channel 131. The grip aperture 132 is located at what is considered to be the top 161 of the luggage item 103. The plurality of wheel cavities 133 are formed at the end of the luggage item 103 that is distal from the grip aperture 132 is considered to be the bottom 162 of the luggage item 103. The extendable handle 101 projects through the grip aperture 132 such that the extendable handle 101 may be withdrawn from the center channel 131 such that the extendable handle 101 projects into the exterior space of the luggage item 103. The invention 100 is designed such that each of the plurality of wheel mechanisms 102 is stored in a wheel cavity selected from the plurality of wheel cavities 133. Each of the plurality of wheel mechanisms 102 is mechanically linked to the extendable handle 101 such that when the extendable handle 101 is withdrawn from the center channel 131 each of the plurality of wheel mechanisms 102 extends out of its corresponding wheel cavity into the exterior space of the luggage item 103. Each of the plurality of wheel covers 134 is used to enclose a wheel cavity selected from the plurality of wheel cavities 133 for the purpose of protecting the wheel mechanism contained within the selected wheel cavity when the invention 100 is not in use.

The extendable handle 101 comprises a shaft 111, a grip 112, and a cross brace 113. The shaft 111 is a first member that is further defined with a first end 151 and a second end 152. The cross brace 113 is a third member that is further defined with a third end 153 and a fourth end 154. The grip 112 is a second member. Within this disclosure, it will be assumed that the first member, second member, and third member are cylindrical shafts. This assumption is made for the purpose of improving the clarity and simplicity of the exposition of the disclosure and is not intended to limit the scope of the specification or the scope of the claims within this disclosure. Those skilled in the mechanical arts will recognize that alternate structures can be readily substituted for a cylindrical shaft without undue experimentation. Examples of such alternate structures include, but are not limited to, commercially available rectangular metal tubing.

The first end 151 of the shaft 111 attaches to the center of the grip 112 such that the center axis of the grip 112 is perpendicular to the center axis of the shaft 111. The second end 152 of the shaft 111 attaches to the cross brace 113 such that the center axis of the cross brace 113 is perpendicular to the center axis of the shaft 111. The extendable handle 101 is contained within the center channel 131. The center channel 131 is an enclosed cavity that is formed within the luggage item 103. The end of the center channel 131 that is proximal to the first end 151 of the shaft 111 contains the grip aperture 132. The grip aperture 132 is an aperture that is sized to allow the shaft 111 to be inserted through the grip aperture 132. The grip 112 is attached to the first shaft 111 after the first shaft 111 is inserted through the grip aperture 132 such that the grip aperture 132 is between the grip 112 and the second end 152 of the shaft 111. This arrangement allows the bulk of the extendable handle 101, with the exception of the grip 112, to be stored within the interior of the luggage item 103. The extendable handle 101 is installed with the mechanisms necessary to allow the extendable handle 101 to be extended out of and retracted into the luggage item 103. Such mechanisms are well known in the manufacturing arts.

Each of the plurality of wheel mechanisms 102 comprises a collection of individual wheel mechanisms 120. Each of the plurality of wheel mechanisms 102 are identical. Each individual wheel mechanism 120 is installed in a wheel cavity selected from the plurality of wheel cavities 133. Each of the plurality of wheel cavities 133 is a cavity that is formed in the luggage item 103 such that each of the plurality of wheel cavities 133 is accessible from the exterior of the luggage item 103.

Each individual wheel mechanism 120 comprises a wheel 121, a wheel mount 122, a pivot 123, a pulley 124, a cable 125, and a spring 129. The cable 125 is a cord that is further defined with a fifth end 155 and a sixth end 156. The spring 129 is further defined with a seventh end 157 and an eighth end 158. The wheel 121 is a commercially available wheel. The wheel 121 is mounted in the wheel mount 122 such that the wheel 121 can rotate freely within the wheel mount 122. As shown most clearly in FIG. 6, the wheel mount 122 is a mounting structure that further comprises a fork 126, an axle shaft 127, and a rotating shaft 128. The fork 126 comprises two parallel plates between which the wheel 121 is inserted such that the arc of rotation of wheel 121 is parallel to the planes of the two parallel plates. The two parallel plates of the fork 126 attach to each other using the rotating shaft 128 such that the fork 126 will rotate around the center axis of the rotating shaft 128. The ends of the rotating shaft 128 are attached to the interior walls of the selected wheel cavity associated with the individual wheel mechanism 120. The rotating shaft 128 effectively forms the pivot 123 around which the individual wheel mechanism 120 will rotate to extend the wheel mount 122 and wheel 121 out of the selected wheel cavity. The axle shaft 127 attaches the wheel 121 to the wheel mount 122 such that the wheel 121 is able to rotate around the axle shaft 127. Attaching wheels to objects using axles is well known and documented in the mechanical arts. The method described in this paragraph is similar to a commonly used method of mounting of a wheel within any one of several commercially available casters.

Figure 5:
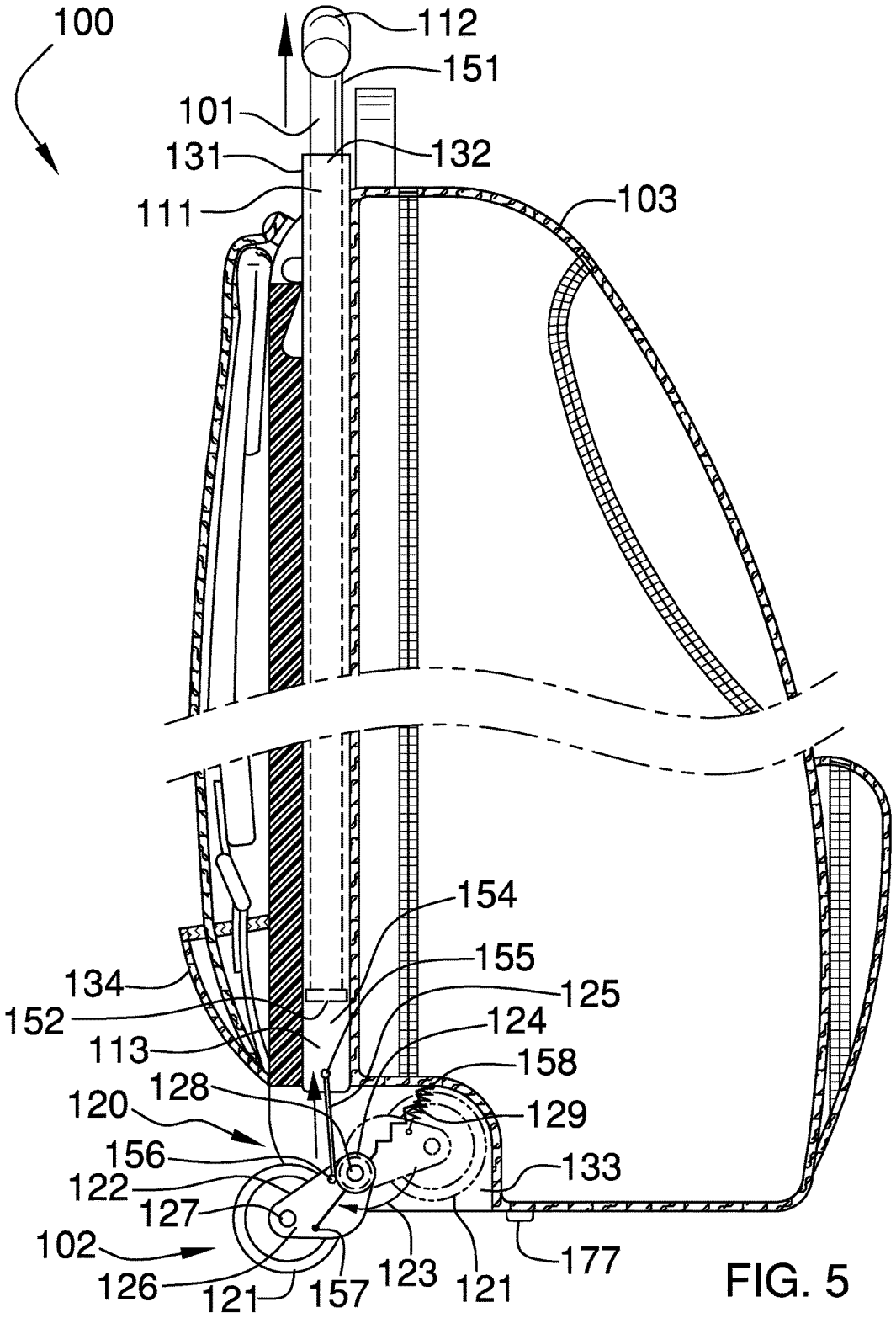
FIG. 5 is a cross-sectional view of an embodiment of the disclosure across 5-5 as shown in FIG. 2.
Figure 6:
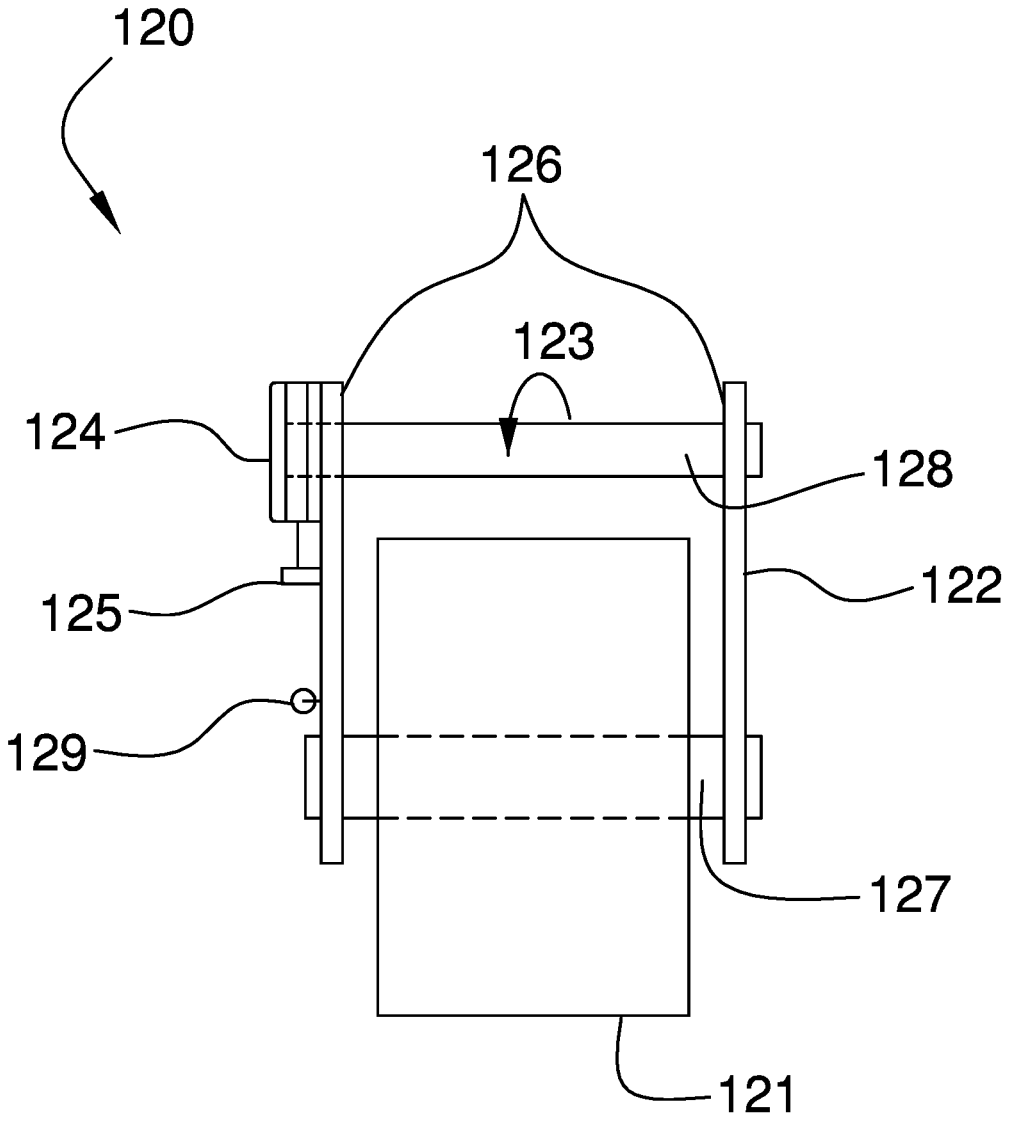
FIG. 6 is a detail view of an embodiment of the disclosure.

As shown most clearly in FIG. 6, a pulley 124 is attached to the fork 126 such that: 1) the pulley 124 fits around the rotating shaft 128; and, 2) the center axis of the pulley 124 is aligned with the center axis of the rotating shaft 128. As shown most clearly in FIG. 3, when the wheel mount 122 is in the retracted position, the cable 125 is looped around the pulley 124 such that the linear direction of the cable 125 is changed. The fifth end 155 of the cable 125 is attached to an end of the cross brace 113 selected from the group consisting of the third end 153 and the fourth end 154. The sixth end 156 of the cable 125 is attached to the fork 126 of the wheel mount 122. As contrasted most clearly between FIGS. 3 and 5, when the grip 112 is extended away from the grip aperture 132 the shaft 111 and the cross brace 113 are raised in the vertical direction thus pulling on the cable 125. The cable 125 rotates the wheel mount 122 around the pivot 123 formed by the rotating shaft 128 in a manner that extends the wheel mount 122 and the wheel 121 into the exterior space beyond the luggage item 103. In this position, the wheel 121 is able to roll the luggage item 103.

As shown in most clearly in FIG. 5, the spring 129 is a readily and commercially available tension spring. The seventh end 157 of the spring 129 is attached to the fork 126. The eighth end 158 of the spring 129 is attached to an interior surface of the selected wheel cavity. As contrasted most clearly between FIGS. 3 and 5, when the extendable handle 101 is raised in the vertical direction, the rotation of the wheel mount 122 places the spring 129 under tension. When the extendable handle 101 is retracted vertically into the center channel 131, the spring 129 tension is relaxed and the spring 129 pulls the wheel mount 122 back into the selected wheel cavity.

Each wheel cavity selected from the plurality of wheel cavities 133 is protected by a wheel cover selected from the plurality of wheel covers 134. Each of the plurality of wheel covers 134 is a textile flap that is attached to the luggage item 103 such that the individual wheel mechanism 120 can be enclosed within the selected wheel cavity by the selected wheel cover. Each selected wheel cover is secured over the selected wheel cavity using a fastener 135. The fastener 135 is a commercially available fastener that is selected from the group consisting of a zipper, a snap 177, or a hook and loop fastener.

In the first potential embodiment of the disclosure, the plurality of wheel mechanisms 102 comprises a left wheel mechanism 171 and a right wheel mechanism 172. The plurality of wheel cavities 133 comprises a left wheel cavity 173 and a right wheel cavity 174. The plurality of wheel covers 134 comprises a left wheel cover 175 and a right wheel cover 176. A snap 177 is used as the fastener 135 for each of the plurality of wheel covers 134. The cable 125 is formed from a metal wire.

In the first potential embodiment of the disclosure, the luggage item 103 is a backpack 140. The interior space of the backpack 140 is further subdivided into a plurality of storage compartments comprising a main compartment 141, a secondary compartment 142, and a front compartment 143. The exterior surface of the backpack 140 is further fitted with a plurality of pockets for the purpose of providing readily accessible storage locations. The plurality of pockets comprises a first pocket 144, a second pocket 145, a third pocket 146 and a mesh pocket 147. The backpack 140 further comprises a first shoulder strap 148 and a second shoulder strap 149 which are used as a harness to attach the backpack 140 to the back of a traveler. The backpack 140 further comprises a fixed handle 150 for the purpose of moving the backpack 140 short distances.

The following definitions were used in this disclosure:

Axle: As used in this disclosure, an axle is a cylindrical shaft that is inserted through the center of one or more wheels such that the center axis of the one or more wheels and the center axis of the axle are aligned.

Backpack: As used in this disclosure, a backpack is an item of luggage that comprises a harness arrangement that allows the backpack to be carried on the back of a traveler. The harness arrangement commonly comprises a plurality of shoulder straps.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects.

Correspond: As used in this disclosure, the term correspond means that a first object is in some manner linked to a second object in a one to one relationship.

Exterior: As used in this disclosure, the exterior is use as a relational term that implies that an object is not contained within the boundary of a structure or a space.

Fastener: As used in this disclosure, a fastener is a device that is used to join or affix two objects. Fasteners generally comprise a first element, which is attached to the first object and a second element which is attached to the second object such that the first element and the second element join to affix the first object and the second object.

Flap: As used in this disclosure, a flap is a piece of material that is hinged or otherwise attached to a surface using one side such that the piece of material hangs in such a way as to cover a hole in the surface.

Harness: As used in this disclosure, a harness is an apparatus comprising a plurality of straps and one or more fasteners that is used to anchor a first person or first object to a second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Interior: As used in this disclosure, the interior is use as a relational term that implies that an object is contained within the boundary of a structure or a space.

Luggage: As used in this disclosure, luggage is a trunk, bag, parcel, suitcase, or backpack in which domestic articles are contained during travel.

Pivot: As used in this disclosure, a pivot is a rod or shaft around which an object rotates or swings.

Pocket: As used in this disclosure, a pocket is a storage space that is formed into an object.

Pulley: As used in this disclosure a pulley is a wheel with a grooved rim around which a cord (or other form of rope, line, or cable) passes. The pulley is used to change the direction of a force applied to the cord.

Shaft: As used in this disclosure, the term shaft is used to describe a rigid cylinder that is often used as the handle of a tool or implement. The terms inner diameter of the shaft and outer diameter of the shaft are used as they would be used by those skilled in the plumbing arts. The definition of shaft explicitly includes solid shafts or shafts that are formed more like pipes with a hollow passage through the shaft that runs along the center axis of the shaft cylinder.

Snap: As used in this disclosure, a snap is a fastener that comprises a male component and a female component. The snap is engaged by pressing the male component into the female component.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Tension Spring: As used in this disclosure, a tension spring, also commonly referred to as an extension spring, is a wire coil that resists forces attempting to pull the wire coil in the direction of the center axis of the wire coil. The tension spring will return to its original position when the pulling force is removed.

Textile: As used in this disclosure, a textile is a material that is woven, knitted, braided or felted. Synonyms in common usage for this definition include fabric and cloth.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification.

Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A container with a retractable rolling device comprising:

an extendable handle, a plurality of wheel mechanisms and a luggage item;

wherein the luggage item comprises a center channel, a grip aperture, a plurality of wheel cavities, and a plurality of wheel covers;

wherein the extendable handle is a handle that is stored within the center channel;

wherein the grip aperture is located the top of the luggage item;

wherein the plurality of wheel cavities are formed at the bottom of the luggage item;

wherein the extendable handle projects through the grip aperture such that the extendable handle may be withdrawn from the center channel such that the extendable handle projects into the exterior space of the luggage item;

wherein each of the plurality of wheel mechanisms is stored in a wheel cavity selected from the plurality of wheel cavities;

wherein each of the plurality of wheel mechanisms is mechanically linked to the extendable handle such that when the extendable handle is withdrawn from the center channel each of the plurality of wheel mechanisms extends out of its corresponding wheel cavity into the exterior space of the luggage item;

wherein each of the plurality of wheel covers encloses a wheel cavity selected from the plurality of wheel cavities;

wherein the extendable handle comprises a shaft, a grip, and a cross brace;

wherein the shaft is a first member that is further defined with a first end and a second end;

wherein the cross brace is a third member that is further defined with a third end and a fourth end;

wherein the grip is a second member;

the first end of the shaft attaches to the center of the grip such that the center axis of the grip is perpendicular to the center axis of the shaft;

wherein the second end of the shaft attaches to the cross brace such that the center axis of the cross brace is perpendicular to the center axis of the shaft;

wherein the center channel is an enclosed cavity that is formed within the luggage item;

wherein the extendable handle is contained within the center channel;

wherein the end of the center channel that is proximal to the first end of the shaft contains the grip aperture;

wherein the grip aperture is an aperture that is sized to allow the shaft to be inserted through the grip aperture;

wherein the grip is attached to the first shaft on the exterior side of the grip aperture;

wherein each of the plurality of wheel mechanisms comprises a collection of individual wheel mechanisms;

wherein each of the plurality of wheel mechanisms are identical;

wherein each of the plurality of wheel cavities is a cavity that is formed in the luggage item such that each of the plurality of wheel cavities is accessible from the exterior of the luggage item;

wherein each individual wheel mechanism is installed in a wheel cavity selected from the plurality of wheel cavities;

wherein each individual wheel mechanism comprises a wheel, a wheel mount, a pivot, a pulley, a cable, and a spring;

wherein the cable is a cord that is further defined with a fifth end and a sixth end;

wherein the spring is further defined with a seventh end and an eighth end;

wherein the wheel, the pulley, the cable, and the spring are attached to the wheel mount;

wherein the wheel is mounted in the wheel mount such that the wheel can rotate freely within the wheel mount;

wherein the wheel mount is a mounting structure that further comprises a fork, an axle shaft, and a rotating shaft;

wherein the axle shaft attaches the wheel to the wheel mount;

wherein the ends of the rotating shaft are attached to the interior walls of the selected wheel cavity associated with the individual wheel mechanism;

wherein the fork comprises two parallel plates between which the wheel is inserted such that the arc of rotation of wheel is parallel to the planes of the two parallel plates;

wherein the two parallel plates of the fork attach to each other using the rotating shaft such that the fork will rotate around the center axis of the rotating shaft;

wherein the rotating shaft forms the pivot around which the individual wheel mechanism will rotate to extend the wheel mount and wheel out of the selected wheel cavity;

wherein a pulley is attached to the fork such that the pulley fits around the rotating shaft;

wherein a pulley is attached to the fork such that the center axis of the pulley is aligned with the center axis of the rotating shaft.

2. The container with a retractable rolling device according to claim 1 wherein the fifth end of the cable is attached to an end of the cross brace selected from the group consisting of the third end and the fourth end;

wherein the sixth end of the cable is attached to the fork of the wheel mount.

3. The container with a retractable rolling device according to claim 2 wherein when the wheel mount is in the retracted position the cable is looped around the pulley such that the linear direction of the cable is changed.

4. The container with a retractable rolling device according to claim 3 wherein the cable rotates the wheel mount around the pivot formed by the rotating shaft in a manner that extends the wheel mount and the wheel into the exterior space beyond the luggage item.

5. The container with a retractable rolling device according to claim 4 wherein the spring is a tension spring;

wherein the seventh end of the spring is attached to the fork;

wherein the eighth end of the spring is attached to an interior surface of the selected wheel cavity;

wherein the spring pulls the wheel mount back into the selected wheel cavity.

6. The container with a retractable rolling device according to claim 5 wherein each of the plurality of wheel covers is a textile flap that is attached to the luggage item such that the individual wheel mechanism can be enclosed within the selected wheel cavity by the selected wheel cover.

7. The container with a retractable rolling device according to claim 6 wherein each selected wheel cover is secured over the selected wheel cavity using a fastener;

wherein the fastener is selected from the group consisting of a zipper, a snap, or a hook and loop fastener.

8. The container with a retractable rolling device according to claim 7 wherein the plurality of wheel mechanisms comprises a left wheel mechanism and a right wheel mechanism;

wherein the plurality of wheel cavities comprises a left wheel cavity and a right wheel cavity;

wherein the plurality of wheel covers comprises a left wheel cover and a right wheel cover;

wherein a snap is used as the fastener for each of the plurality of wheel covers;

wherein the cable is formed from a metal wire.

9. The container with a retractable rolling device according to claim 8 wherein the luggage item is selected from the group consisting of a trunk, a suitcase, or a backpack.

10. The container with a retractable rolling device according to claim 8 wherein the luggage item is a backpack.

11. The container with a retractable rolling device according to claim 10 wherein the interior space of the backpack is further subdivided into a plurality of storage compartments comprising a main compartment, a secondary compartment, and a front compartment;

wherein the exterior surface of the backpack is further fitted with a plurality of pockets for the purpose of providing readily accessible storage locations;

wherein the exterior surface of the backpack is further fitted with a first pocket, a second pocket, a third pocket and a mesh pocket;

wherein the backpack further comprises a first shoulder strap and a second shoulder strap;

wherein the backpack further comprises a fixed handle.

* * * * *